United States Patent [19]

Boeckmann

[11] Patent Number: 5,014,499

[45] Date of Patent: May 14, 1991

[54] STRETCH STRESS RELIEF FOR BAG THERMO-CROSS-SEALS IN VERTICAL FORM, FILL AND SEAL MACHINES

[75] Inventor: Hugo Boeckmann, Arlington Heights, Ill.

[73] Assignee: Zip-Pak, Incorporated, Northbrook, Ill.

[21] Appl. No.: 493,624

[22] Filed: Mar. 15, 1990

[51] Int. Cl.[5] ..... B65B 9/20; B65B 61/28

[52] U.S. Cl. ..... 53/451; 53/551

[58] Field of Search ..... 53/551, 552, 554, 451, 53/526, 527, 373, 386

[56] References Cited

U.S. PATENT DOCUMENTS

| | | | |
|---|---|---|---|
| 3,027,695 | 4/1962 | Leasure | 53/552 x |
| 3,052,074 | 9/1962 | Dreeben | 53/552 |
| 3,210,907 | 10/1965 | Thürlings | 53/551 |
| 3,552,081 | 1/1971 | Leasure | 53/552 X |
| 3,738,080 | 6/1973 | Reil | 53/551 |
| 3,815,317 | 6/1974 | Toss | 53/551 X |
| 4,079,662 | 3/1978 | Puccetti et al. | 53/552 |
| 4,215,520 | 8/1980 | Heinzer et al. | 53/552 X |
| 4,378,666 | 4/1983 | Onishi | 53/551 X |
| 4,829,745 | 5/1989 | Behr et al. | 53/451 |

*Primary Examiner*—Horace M. Culver

*Attorney, Agent, or Firm*—Hill, Van Santen, Steadman & Simpson

[57] ABSTRACT

A support is provided for filled bags in a form, fill and seal package or bag making machine to avoid stretch stress damage to the thermosealed top edge of the filled bag during the cross-sealing and pull-down action of cross-sealing and pull-down bars functioning below the lower or discharge end of the forming and filling tube of the associated form, fill and seal machine. The supoprt may comprise a supporting constant force spring biased finger or a platform plate similarly supported.

12 Claims, 1 Drawing Sheet

STRETCH STRESS RELIEF FOR BAG THERMO-CROSS-SEALS IN VERTICAL FORM, FILL AND SEAL MACHINES

BACKGROUND OF THE INVENTION

The present invention relates to the making of filled bags in vertical form, fill and seal machines, and is more particularly concerned with alleviating the stretch stress at the thermo-cross-seals at the upper ends of filled bags.

In the production of filled bags in a form, fill and seal machine, thermoplastic bag making film is tubularly shaped about a forming and filling tube and drawn downwardly by bag length sections by means of a thermo-cross-sealing mechanism. Such mechanism customarily comprises cooperative reciprocating bars which function to close below the discharge end of the forming and filling tube to seal the top edge of each bag after it is filled, while at the same time sealing the lower edge of the succeeding bag. Then while still gripping the cross-seal, the closed bars pull the bags and the bag making material downwardly a bag length section and release the now sealed and filled bag which has been detached from the next succeeding bag by means associated with the sealing and pull down mechanism. By way of example, U.S. Pat. No. 4,829,745 is referred to as showing a typical machine of the kind described. To any extent necessary, that patent is incorporated herein to lessen the need for a more detailed description of elements environmental to the present invention.

A problem that has been encountered is that since the cross-sealing temperature is such as to initiate fusion, there is a tendency for sagging or stretch stress due to the downward pull from the weight of the filled bag upon the cross-seal at the upper edge of the filled bag. This is particularly true where fairly heavy loads are imposed in the bag contents. The cross-seal is especially vulnerable to stretch damage where the bag making material is equipped with extruded plastic profile reclosable zipper means, and during the cross-sealing there is of necessity fusion at the spot sealing of the substantially greater mass of the zipper profiles as compared to the cross-sectional mass of the bag making film itself.

SUMMARY OF THE PRESENT INVENTION

An important object of the present invention is to provide stretch stress relief for bag thermo-cross-seals in vertical form, fill and seal machines.

A more particular object of the invention is to provide, in such cross-seals, stretch stress relief where the package making material includes extruded thermoplastic zipper profiles.

Another object of the invention is to provide a new and improved method of and means for supporting newly made and filled bags in a vertical form, fill and seal machine.

There is provided by the present invention, in combination with a form, fill and seal package or bag making machine having a vertical forming and filling tube and means below the discharge end of the tube for cross-sealing a continuous tube of zipper profile equipped thermosealable bag making film and thereby thermosealing the top edge of a filled bag and a lower edge of the next succeeding bag and pulling the film and bags downwardly a bag length distance, and then releasing the filled bag to drop away from the next succeeding bag; means for supporting the filled bag during cross-sealing to avoid stretch stress damage to its thermosealed top edge.

There is also provided by the present invention, a method in a form, fill and seal package or bag making machine having a vertical forming end filling tube and means below the discharge end of the tube for cross-sealing a continuous tube of zipper profile equipped thermosealable bag making film for thereby thermosealing the top edge of a filled bag and a lower end of the next succeeding bag and pulling the film and bags downwardly a bag length distance and then releasing the filled bag to drop away from the next succeeding bag, the method comprising, supporting the filled bag during cross-sealing, and thereby avoiding stretch stress damage to its newly thermosealed top edge.

BRIEF DESCRIPTION OF THE DRAWINGS

Other objects, features and advantages of the present invention will be readily apparent from the following description of certain preferred embodiments thereof, taken in conjunction with the accompanying drawings, although variations and modifications may be effected without departing from the spirit and scope of the novel concepts of the disclosure, and in which.

DETAILED DESCRIPTION

Figure 1:
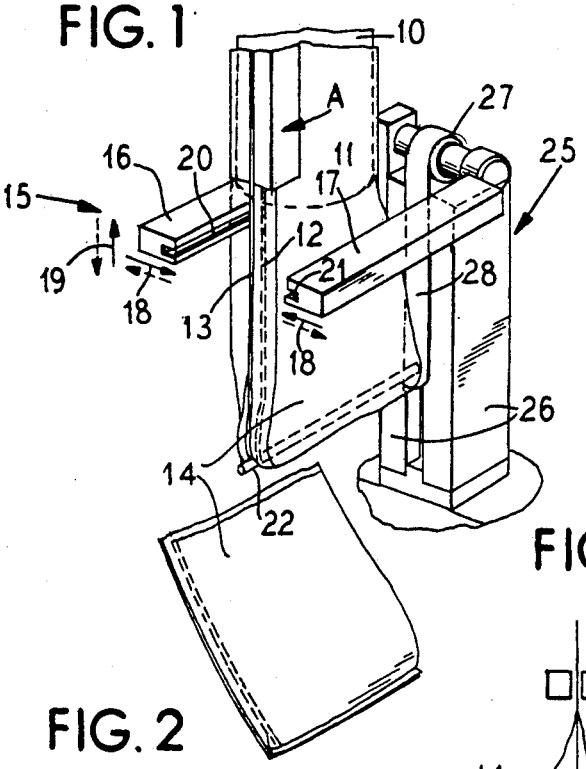
FIG. 1 is a fragmentary, more or less schematic perspective view of the lower portion of a vertical forming and filling tube in a form, fill and seal machine, including the mechanism for cross-sealing the bag making material, and means for stretch stress relief support of the filled bag formed from the bag making material.
Figure 3:
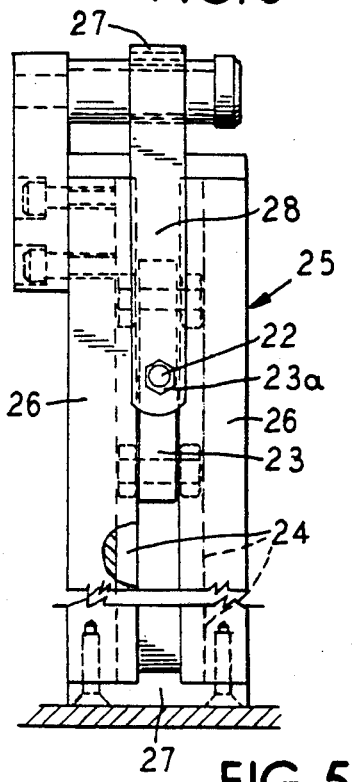
FIG. 3 is a front elevational view of the bag supporting device of FIGS. 1 and 2.

As schematically shown in FIG. 1, a vertical forming and filling tube 10, of a conventional form, fill and seal machine, has bag making sheet material 11 desirable comprising thermosealable film of desired kind and gauge shaped tubularly thereabout. Before the tubularly shaped material 11 advances below the lower end of the tube 10, thermoplastic reclosable, interlocking profile zipper means 12 carried by the material has the profiles reclosably interlocked and a seam 13 desirably formed outwardly from the zipper 12 by means such as a device 14 schematically illustrated and which will be recognized as representive of more or less conventional means for this purpose.

Below the lower end of the tube 10, the now tubularly sealed material 11 is formed into a succession of bags 14 filled by discharge of product contents **14*a* (FIG. 4) from the lower end of the tube 10 and successively cross-sealed and severed by means of cross-sealing, pull down and severing means 14. Schematically, the means 14 is shown as comprising a pair of cooperating bars 15 and 17 which are operable horizontally reciprocably toward and away from one another as indicated by arrows 18 for effecting cross-sealing of the material 11. The bars 15 and 17 and are also vertically reciprocable as indicated by the arrows 19 for effecting pull-down of each filled bag 14 and the next succeeding bag section to be filled. Upon cooperative gripping of the material 11, the bars 15 and 17 effect cross-sealing of the material. While still gripping the material in the cross-sealing mode, the closed bars 15 and 17 pull the bags and material downwardly a bag section distance. The bars 15 and 17 then open and return upwardly to the cross-sealing position. In conjunction with these functions of the bars 15 and 17, there is also effected severance of the just filled bag 14 from the next succeeding bag 14 by means of a suitable severance device such as a knife 20 which may be carried by the bar 15, and which knife is cooperatively accommodated by a complementary groove 21 in the bar 17**.

It will be understood, of course, that the cooperating material gripping sealing surfaces of the bars 15 and 17 will be heated sufficiently, in well known manner, to effect fusion cross-sealing of the material 11 between bags so that the upper edge of the just filled bag 14 will be sealed and the lower edge of the next succeeding bag will be simultaneously sealed. In effecting such sealing, it is necessary to spot seal the zipper 12 not only for severance of the portions of the zipper on the respective bags 14, but also to seal the severed ends of the zipper against separation and leakage, especially where the bags are successively filled with a nonoxidizing gas such as nitrogen, which is a common practice for maintaining freshness of various food products purveyed in bags such as the bags 14.

Figure 4:
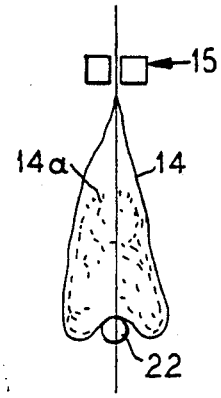
FIG. 4 is a schematic illustration of how the device of FIGS. 1–3 supports a filled bag during cross-sealing.
Figure 2:
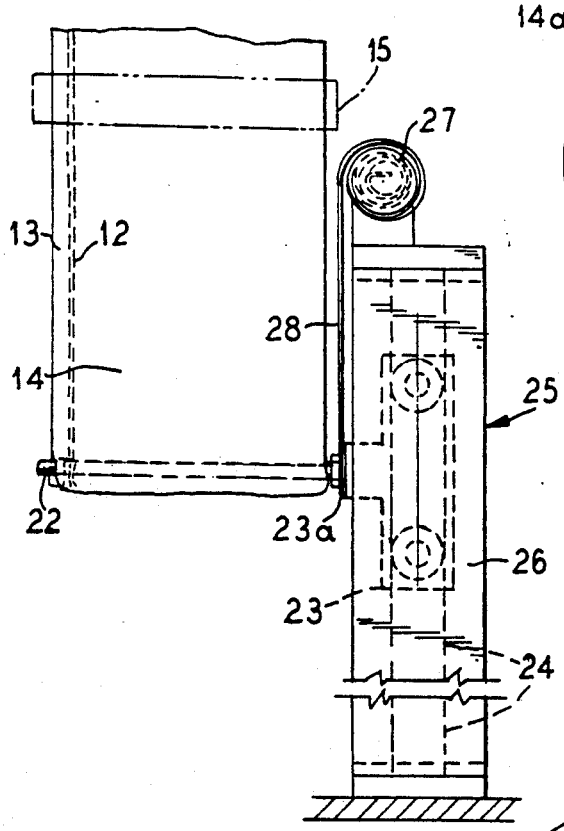
FIG. 2 is an enlarged fragmental side elevational view of the bag supporting device shown in FIG. 1.

According to the present invention, means are provided (FIGS. 1–4) for supporting the filled bag 14 during the cross-sealing operation and thereby avoiding sagging or stretch stress damage to the newly thermosealed top edge of the filled bag. In one desirable form, such means comprise an underlying supporting finger 22, which is located to extend lengthwise under the lower edge of the filled bag 14 (FIGS. 1, 2 and 4). The finger 22 is carried by yieldable means calculated to maintain sufficient support under the filled bag 14 for the needed stretch stress relief, but to yieldably descend with the filled bag as the filled bag is pulled down by the sealing and pull down means 14.

In a preferred construction, the yieldable supporting means for the finger 22 comprises a wheeled carriage 23 running in vertical tracks 24 provided by a stand 25, including spaced parallel vertical members 26, supported by a base 27. Yieldable upward biasing means for the carriage 23 and thereby the finger 22, which is rigidly supported by the carriage through a boss **23*a*, comprises a constant force spring 27 of generally clock spring type mounted on top of the stand 25 and having a depending end portion 28 secured to the carriage 23 preferably at the attachment of the finger 22 to the carriage. In a desirable arrangement, where, for example, the total filled bag weight and pull down force applied by the device 14 may be about four pounds, the constant force spring 27 may have an upwardly biasing reaction of about three pounds. This will afford sufficient upward lifting force on the bottom of the filled bag 14 while it is being filled and then pulled down to afford the desired avoidance of stretch stress damage to the cross-seal newly formed by the sealing and pull down jaws 15 at the upper edge of the filled bag 14**.

Upon release of the filled bag 14 by opening of the jaws 15 at the low end of their vertical operating cycle, the filled bag 14 which has been separated from the next succeeding bag 14 drops off of the finger 22, and the upward bias of the spring 27 lifts the finger into position under the next succeeding bag 14 as it is filled by discharge of product from the tube 10, and the cycle is repeated.

Instead of the stretch stress relief finger 22, a stretch stress relief platform plate 29 (FIGS. 5 and 6) may be employed. This plate 29 may be supported yieldably in the same manner as the finger 22, having an anchor bar 30 along its supported end which is attached to the carriage 23. The biasing spring portion 28 may be secured to the plate 29 in substantially similar manner as was effected with respect to the finger 22.

Figure 5:
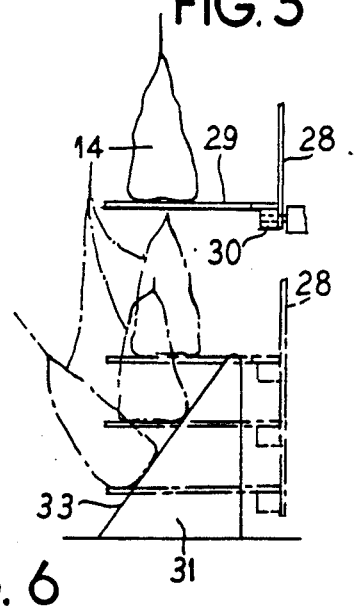
FIG. 5 is a fragmentary side elevational view of a modified bag supporting member for the stretch stress relief device.
Figure 6:
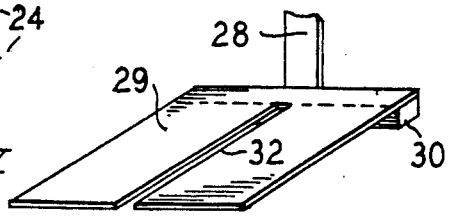
FIG. 6 is a perspective view of the bag supporting member of FIG. 5.

Operation of the platform plate 29 will be understood to be substantially the same as described for the finger 22. However, instead of the filled bag 14 simply dropping off of the plate 29, push-off means are desirably provided comprising an upwardly projecting fin 31 which is received through a forwardly opening clearance slot 32 in the plate 29 so that a downwardly and forwardly sloping push-off cam edge 33 on the fin engages behind the filled bag 14, substantially as schematically illustrated in FIG. 5. As the bag 14 descends after it is separated from the next succeeding bag 14, the weight on the platform plate 29 causes it to descend, and the cam edge 33 pushes the filled bag off of the platform plate. Immediately upon push-off or dumping of the filled bag 14 from the platform plate 29, the yieldable biasing spring pulls the plate upwardly into position to receive the next succeeding filled bag.

It will be understood that variations and modifications may be effected without departing from the spirit and scope of the novel concepts of the present invention.

I claim as my invention:

1. In combination with a form, fill and seal package or bag making machine having a vertical forming and filling tube and means below the discharge end of said tube for cross-sealing a continuous tube of zipper profile equipped thermosealable bag making film for thermosealing the top edge of a filled bag and the lower edge of the next succeeding bag and pulling the film and bags downwardly a bag length distance and then releasing the filled bag to drop away from the next succeeding bag:

means for supporting the filled bag on a platform plate during cross-sealing to avoid stretch stress damage to its thermosealed top edge;

said platform plate having a slot;

and a push-off received in said slot with a cam edge for displacing the filled bag from the platform plate.

2. In combination with a form, fill and seal package or bag making machine having a vertical forming and filling tube and means below the discharge end of said tube for cross-sealing a continuous tube of zipper profile equipped thermosealable bag making film for thermosealing the top edge of a filled bag and the lower edge of the next succeeding bag and pulling the film and bags downwardly a bag length distance and then releasing the filled bag to drop away from the next succeeding bag:

means for supporting the filled bag on a platform plate during cross-sealing to avoid stretch stress damage to its thermosealed top edge;

said supporting means comprising a downwardly yieldable support which follows the filled bag as it is pulled downwardly;

a constant force spring providing yieldable bias for said support and mounted on top of a stand;

said stand having track means;

and a carriage running in said track means carrying said support and attached to an end portion of said spring.

3. A combination according to claim 2, wherein said support comprises a horizontal member extending cantilever fashion from said carriage and said spring end portion extends downwardly and is attached between said member and said carriage.

4. A device for supporting filled bags during cross-sealing to avoid stretch stress damage in thermosealed top edges of filled bags in a form, fill and seal package or bag making machine having a vertical forming and filling tube and means below the discharge end of the tube for cross-sealing a continuous tube of zipper profile equipped thermosealable bag making film and thereby thermosealing the top edge of a filled bag and pulling the film and bags downwardly a bag length distance, and then releasing the filled bag to drop away from the next succeeding bag:

said device comprising a horizontal support member for engaging under the filled bag; and means for normally yieldably upwardly biasing said support member accommodating vertical downward movement of the member as the bag descends;

and push-off means forcing the bag off the support member as the bag has descended.

5. A device for supporting filled bags during cross-sealing to avoid stretch stress damage in thermosealed top edges of filled bags in a form, fill and seal package or bag making machine having a vertical forming and filling tube and means below the discharge end of the tube for cross-sealing a continuous tube of zipper profile equipped thermosealable bag making film and thereby thermosealing the top edge of a filled bag and pulling the film and bags downwardly a bag length distance, and then releasing the filled bag to drop away from the next succeeding bag constructed in accordance with claim 4, wherein said push-off means includes an angular cam engaged by the bag as it descends to force the bag off of the support member.

6. A device for supporting filled bags during cross-sealing to avoid stretch stress damage in thermosealed top edges of filled bags in a form, fill and seal package or bag making machine having a vertical forming and filling tube and means below the discharge end of the tube for cross-sealing a continuous tube of zipper profile equipped thermosealable bag making film and thereby thermosealing the top edge of a filled bag and pulling the film and bags downwardly a bag length distance, and then releasing the filled bag to drop away from the next succeeding bag constructed in accordance with claim 4, wherein said horizontal support member remains horizontal from an upward position where the bag is filled to a lower position where the bag is pushed off the support member.

7. A device for supporting filled bags during cross-sealing to avoid stretch stress damage in thermosealed top edges of filled bags in a form, fill and seal package or bag making machine having a vertical forming and filling tube and means below the discharge end of the tube for cross-sealing a continuous tube of zipper profile equipped thermosealable bag making film and thereby thermosealing the top edge of a filled bag and pulling the film and bags downwardly a bag length distance, and then releasing the filled bag to drop away from the next succeeding bag constructed in accordance with claim 4, wherein said upwardly biasing means applies a vertical support force to the bag less than the weight of the bag.

8. A device for supporting filled bags during cross-sealing to avoid stretch stress damage in thermosealed top edges of filled bags in a form, fill and seal package or bag making machine having a vertical forming and filling tube and means below the discharge end of the tube for cross-sealing a continuous tube of zipper profile equipped thermosealable bag making film and thereby thermosealing the top edge of a filled bag and pulling the film and bags downwardly a bag length distance, and then releasing the filled bag to drop away from the next succeeding bag:

said device comprising a support member for engaging under the filled bag;

means for normally yieldably upwardly biasing said support member;

said support member comprising a platform plate;

said platform plate having a slot;

and a push-off fin received in said slot with a cam edge for displacing the filled bag from the platform plate.

9. A device for supporting filled bags during cross-sealing to avoid stretch stress damage in thermosealed top edges of filled bags in a form, fill and seal package or bag making machine having a vertical forming and filling tube and means below the discharge end of the tube for cross-sealing a continuous tube of zipper profile equipped thermosealable bag making film and thereby thermosealing the top edge of a filled bag and pulling the film and bags downwardly a bag length distance, and then releasing the filled bag to drop away from the next succeeding bag:

said device comprising a support member for engaging under the filled bag;

means for normally yieldably upwardly biasing said support member;

said spring being a constant force spring providing yieldable upward bias for said support;

a stand on which said spring is mounted having track means;

and a carriage running in said track means carrying said support and being attached to an end portion of said spring.

10. A device according to claim 9, wherein said support comprises a horizontal member extending cantilever fashion from said carriage and said spring end portion extends downwardly and is attached between said member and said carriage.

11. A method in a form, fill and seal package or bag making machine having a vertical forming and filling tube and means below the discharge end of said tube for cross-sealing a continuous tube of zipper profile equipped thermosealable bag making film for thermosealing the top edge of a filled bag and the lower edge of the next succeeding bag and pulling the film and bags downwardly a bag length distance and then releasing the filled bag to drop away from the next succeeding bag, said method comprising:

vertically supporting the filled bag on a horizontal support during cross-sealing with an upward bias less than the weight of the filled bag, and thereby avoiding stretch stress damage to the newly thermosealed top edge.

12. A method according to claim 11, which comprises effecting said support by engaging the bottom of the filled bag with an upwardly biased member which is downwardly yieldable with the filled bag maintaining horizontal support in movement of the bag from an upper filling position to a lower discharge position; and pushing the bag off the support in said lower position.

* * * * *